US005320051A

United States Patent [19]

Nehls, Jr.

[11] Patent Number: 5,320,051

[45] Date of Patent: Jun. 14, 1994

[54] FLYASH INJECTION SYSTEM AND METHOD

[76] Inventor: George R. Nehls, Jr., 1315 N. Seventh Ave. E., Duluth, Minn. 55805

[21] Appl. No.: 902,667

[22] Filed: Jun. 29, 1992

Related U.S. Application Data

[63] Continuation-in-part of Ser. No. 726,927, Jul. 8, 1991.

[51] Int. Cl.[5] ..... F23J 11/00

[52] U.S. Cl. ..... 110/345; 110/346; 110/347; 110/245

[58] Field of Search ..... 110/345, 346, 347, 245, 110/215; 122/4 D

[56] References Cited

U.S. PATENT DOCUMENTS

| | | | |
|---|---|---|---|
| 3,249,075 | 5/1966 | Nelson et al. . | |
| 4,369,719 | 1/1983 | Engstrom et al. . | |
| 4,480,593 | 11/1984 | Robinson . | |
| 4,509,436 | 4/1985 | Schrofelbauer et al. . | |
| 4,651,653 | 3/1987 | Anderson et al. | 110/245 |
| 4,761,131 | 8/1988 | Abdulally . | |
| 4,788,917 | 12/1988 | Hogue . | |
| 4,796,548 | 6/1989 | Merrell et al. . | |
| 4,809,623 | 3/1989 | Garcia-Mallol . | |
| 4,915,039 | 4/1990 | Ringel . | |
| 4,981,111 | 1/1991 | Bennett et al. . | |
| 5,020,456 | 6/1991 | Khinkis et al. | 110/345 |
| 5,024,169 | 6/1991 | Borowy . | |
| 5,035,188 | 7/1991 | Johnson et al. | 110/215 |
| 5,044,286 | 9/1991 | Breen et al. . | |
| 5,176,513 | 1/1993 | Zinn et al. | 110/245 |
| 5,186,901 | 2/1993 | Bayer et al. | 110/245 |

OTHER PUBLICATIONS

W. D. Kingery et al., *Introduction to Ceramics*, 2nd ed.; John Wiley & Sons: New York (1976); pp. 425–430.

L. E. Ehrenreich et al., "Investigation of Composites Utilizing Low-Cost Small Diameter Spheres as a Filler", *33rd Annual Technical Conference, Reinforced Plastics/Composites Institute, The Society of the Plastics Industry, Inc.*, Section 2-A, 1 (1978).

L. A. Scandrett et al., *J. Institute of Energy*, 391 (Dec. 1984).

L. J. Wibberley et al., *Combust. Sci. and Tech., 48*, 177 (1986).

H. S. Katz, *Handbook of Fillers for Plastics*; H. S. Katz, ed.; Van Nostrand Reinhold Company: New York, 1988; Chapter 21.

W. A. Punjak and F. Shadman, "Aluminosilicate Sorbents for Control of Alkali Vapors during Coal Combustion and Gasification", *Energy & Fuels, 2* 702–708 (1988).

*Primary Examiner*—Henry C. Yuen

*Attorney, Agent, or Firm*—Merchant, Gould, Smith, Edell, Welter & Schmidt

[57] ABSTRACT

The present invention provides a system and method for conducting a coal combustion process, including methods of improving the opacity of the off-gases or inhibiting ash fouling. The method includes a step of combusting pulverized coal to form flyash, including a fume component formed from organically associated inorganics in the pulverized coal, and combustion off-gases, and a step of injecting a substantially noncombustible, preformed, coarse particulate material into the combustion process.

7 Claims, 3 Drawing Sheets

FIG. 1
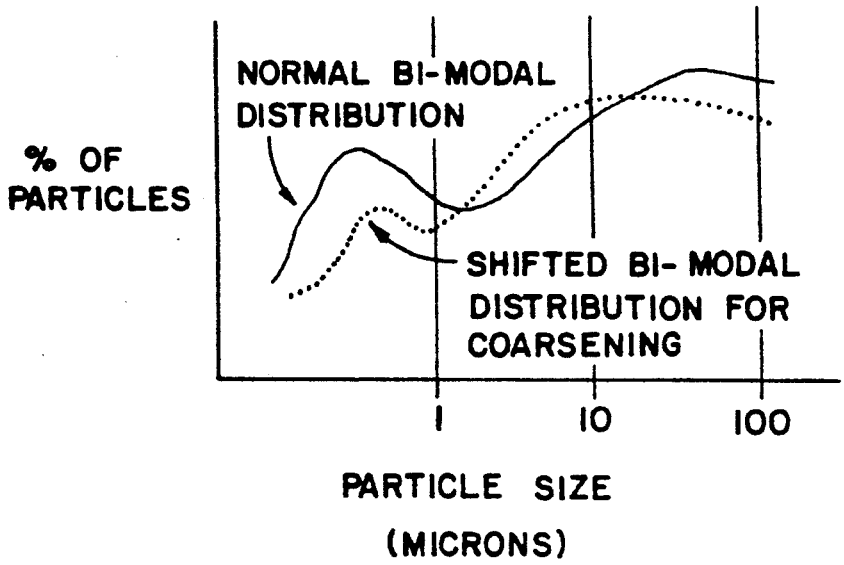
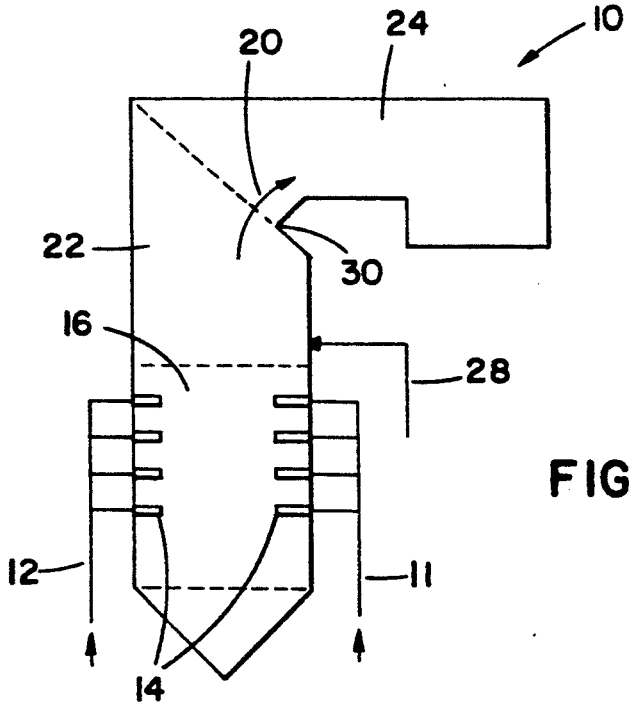
FIG. 2

FLYASH INJECTION SYSTEM AND METHOD

CROSS REFERENCE TO RELATED APPLICATION

This is a Continuation-In-Part of U.S. Ser. No. 07/726,927 filed Jul. 8, 1991. The parent is incorporated herein by reference.

FIELD OF THE INVENTION

The present invention concerns combustion processes. Specifically it concerns the control of emissions from combustion processes such as coal-fired processes. It also concerns the control of flyash deposition within a coal-fired furnace or boiler. Specific techniques described herein may be used to control the content of emissions from boiler stacks and also to inhibit flyash fouling in boiler arrangements.

BACKGROUND OF THE INVENTION

The combustion of coal in a boiler, as in a pulverized coal-fired electric power generating plant, produces flyash. The composition of the flyash varies depending, for example, on the composition of the coal and the combustion conditions. Generally, flyash is a fine, solid, noncombustible mineral residue, which is distinct from bottom ash, cinders, or slag. Flyash can have widely varying particle size, density, shape, porosity, internal structure, and surface chemistry. It is typically composed of oxidized silicon, aluminum, calcium, iron, titanium, magnesium, sodium, potassium, sulfur, etc.

The sources of flyash from coal can generally be classified into two categories: mineral inclusions, i.e., extraneous minerals; and, organically associated inorganic elements ("OAI's" or inherent minerals). Inherent minerals are the components of the coal, such as sulfur, sodium, calcium, and potassium, which are not present as mineral inclusions in the coal matrix, but are actually associated with the chemical structure of the complex hydrocarbons which make up the coal's combustible component. The mineral inclusions are the solid, generally crystalline, compounds that are found in salt, rock, clay, and iron pyrites, for example.

The formation of flyash during coal combustion generally depends upon the transformation of minerals during the pyrolytic process of combustion, and the release of inorganic elements on an atomic or near atomic scale from the hydrocarbon matrix that comprises the structure of the coal itself. The inorganic elements released from the organically associated inorganics form a "fume," i.e., a suspension of particles in a gas, with an average particle size of about 1 micron or less. In some instances, the minerals which form the fume will be such as to exist in the vapor state, at least when the fume is the hottest. This may be the case, for example, for sodium and potassium oxides. Typically, the fume is composed of oxides of such elements as sodium, calcium, potassium, and magnesium.

Mineral associated flyash, i.e., ash formed from the mineral inclusions, commonly exists in a fairly wide range of particle sizes. Generally, however, it is most often between about 1 micron and about 100 microns in size (diameter). That is, the particle size distribution of the flyash formed from the mineral inclusions is typically such that the bulk of it, by weight, is of particles about 2 to 70 microns in diameter. In flyash, such materials are often generated from coal as glassy cenospheres.

Disposition of flyash from coal-burning installations such as power generating plants is an increasingly difficult problem. Strict environmental restrictions pertaining to air quality standards and the handling and final placement of flyash have combined to make flyash a source of escalating processing costs and environmental concerns common to nearly all coal-burning plants. To meet the environmental standards, flyash is generally removed from the exiting coal combustion off-gases by such arrangements as scrubbers or baghouses. In a typical example, the gas is fed through a shower of water, such as droplets in a venturi scrubber (or aqueous scrubber). The flyash is collected by the water as the gas passes therethrough. The gas is thereby cleansed and the particulate matter in the water is collected or settled in a pond.

The efficiency of collection of particulate collection equipment is often dependent upon particle size. More specifically, typical particle collection equipment experiences a substantial drop in collection efficiency when the particle size drops below about 1 micron in effective diameter. The drop or "roll off" in efficiency can be substantial. Collection efficiencies exceeding 99% are normal for most devices when collecting particle in a size range from several microns in diameter on up. However, collection efficiencies of about 50% or lower are often experienced for the same equipment when the particle size is smaller than 1 micron. Collection efficiency generally worsens as particle size decreases.

Stack "opacity" is a government regulated flyash emission parameter. It generally concerns definition of the "clarity" of stack emission; i.e., percent transmission through a volume of stack emissions. In general, the greater the opacity, the more contaminated the emissions. (Although smaller particles, i.e., particles of about 1 micron or less in size, may have a disproportionate effect in causing stack opacity.) Extreme stack opacity values can limit the types of coal and/or amount of power that can be produced at a generating unit. That is, certain types of coal cannot be burned without extremely efficient scrubber systems or reduced power output because they generate a large amount of particulate matter, which contributes to opacity. Therefore, some coal-burning facilities are limited in the types of coal that can be burned in order to meet particulate emission standards.

What has been needed is still further systems and methods for reduction in the amount of flyash emissions from combustion processes. In particular, what has been needed is a method to eliminate a substantial portion of ultrafine particulate (about 1 micron or less in diameter) from a combustion gas stream, prior to the gas stream's entrance into a conventional particulate collection device. Thus, the gas stream being emitted to the environment would be largely devoid of both normal fly ash and ultrafine particulate. Such systems and methods would allow a wider range of coals to be burned without penalty, resulting in a more aggressive coal fuel purchasing strategy, and reduced cost of electricity production. The particulate emissions can be reduced; and, the power plant can regain a greater total power output (within opacity limits), if it was "opacity limited." Other advantages may result, such as reduced sulfur, toxic materials and/or flyash output from the plant as a result of the properties of the new coal used.

In addition to flyash emission problems, coal-burning facilities are faced with ash fouling problems. This is because coal-burning facilities have become more efficient by increasing the temperature of the steam produced in the boiler. Boilers, and the tubing (heat exchange surfaces) in the boilers, have also been improved so as not to be the limiting factor in obtaining these high temperatures. However, if the boiler tubes (or heat exchange surfaces) are so hot that they exceed the fluxing temperatures of the flyash which is being transported through the tubes along with the combustion off-gases, the flyash can adhere to the tubes. The flyash deposits can then build up in the tubes and interfere with the movement of off-gases and the rate of steam production. This detrimentally effects the efficiency and capacity of the boiler.

Certain types of coal that produce a relatively low amount of flyash upon combustion can be burned, with concomitant reduction in this ash buildup, i.e., ash fouling, problem. However, this is not always economically efficient. It has also been suggested that vermiculite can be added to the gases and flyash produced during a combustion process. This method, however, does not prevent the formation of flyash deposits. The vermiculite actually combines with the flyash to form ash deposits. Although these deposits are easier to remove than pure ash deposits due to the ability of the vermiculite to expand when exposed to elevated temperatures, they must still be removed by the application of jets of steam or soot blowers. It is, therefore, generally desirable to develop a system and method that reduces the amount of flyash buildup in the boiler system.

BRIEF DESCRIPTION OF THE DRAWINGS

FIG. 1 is a graphical representation of the particle size distribution of flyash.

FIG. 2 is a schematic diagram of a typical 500 MW (Megawatt) boiler modified according to the present invention showing the direction of gas flow and the preferred location for particulate material injection into the boiler.

SUMMARY OF THE INVENTION

Figure 3:
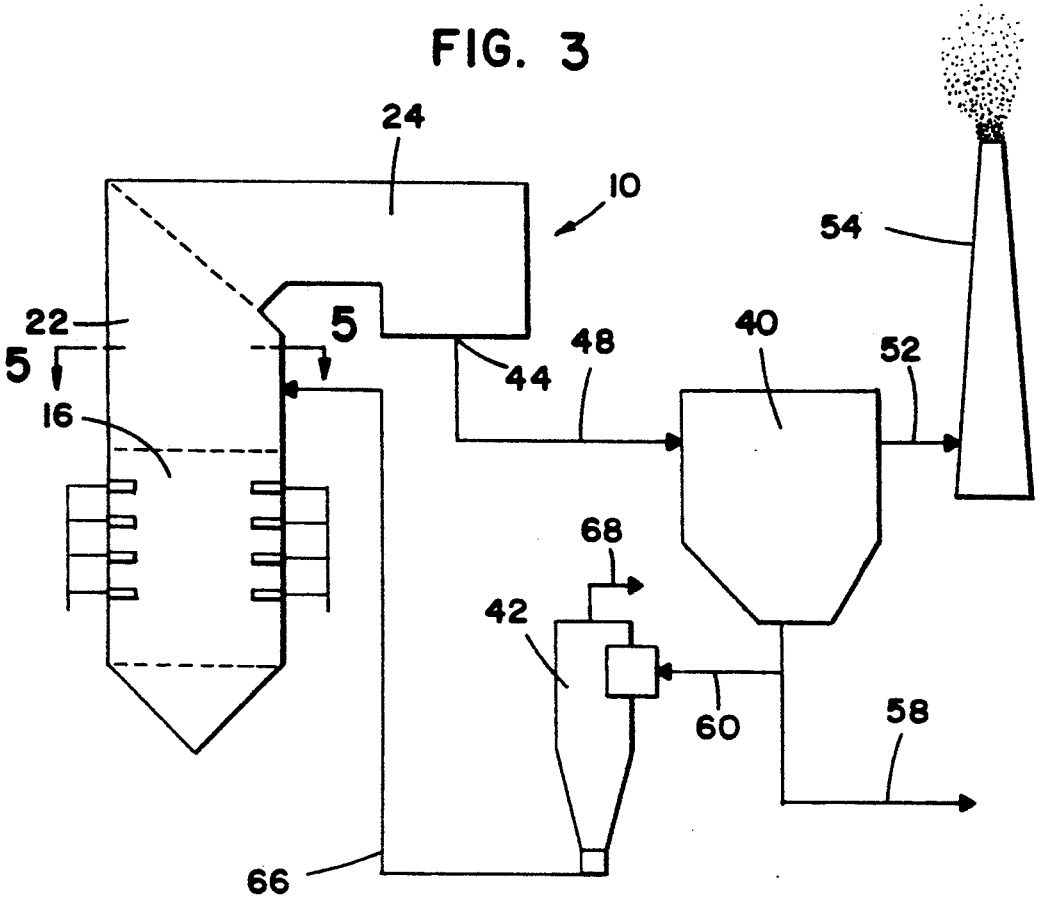
FIG. 3 is a schematic diagram of a preferred embodiment of the particulate material injection system of the present invention including flyash recirculation.

While the present invention has many applications, including, for example, in waste incineration, it is foreseen that a primary application is for the control of combustion processes involving pulverized coal. In particular, the present invention may be applied to control or limit emission of ultrafine particulates (particles of about 1 micron or less in size) and/or to control the opacity of off-gases, i.e., the combustion gases, from a pulverized coal combustion process. In addition, and in some instances simultaneously, the present invention may be applied to inhibit ash fouling in a boiler system used to contain a pulverized coal combustion process.

Herein the term "pulverized coal" combustion process, and variants thereof are meant to refer to processes involving the combustion of coal which has been pulverized. A pulverized coal combustion process may concern for example, combustion in a boiler system for the production of electrical energy. Typically, in pulverized coal about 70–80% of the material is smaller than a particle size of about 200 mesh.

A typical pulverized coal-fired combustion process in a boiler system involves combustion of the coal to generate off-gases having entrained therein flyash material. The flyash material generally includes a fume component, comprising very small or ultrafine (typically submicron up to about 1 micron) particles and vapors formed from organically entrained, i.e., associated, inorganics (also known as inherent minerals) in the coal. Such materials may include, for example, sodium oxides, potassium oxides, calcium oxides, and magnesium oxides as well as toxic materials such as mercury or heavy metals. Another component of the flyash formed during the combustion process (and suspended in the combustion off-gases) is a mixture of materials formed from mineral inclusions, i.e., extraneous minerals, in the coal. The principal components of such flyash material are generally silicon based oxides. Such materials are typically formed, under the conditions of a coal-fired combustion process, in small glassy cenospheres ranging in size from about 1 micron to about 100 microns or more. Typically, the bulk of such components by weight is in about the 2 to 70 micron range; however, this can vary depending on the type of coal and combustion conditions, for example.

The typical coal-fired combustion process involves, downstream from the boiler arrangement or similar structure, an off-gas system including a particulate removal arrangement for removal of a substantial portion of the particulates entrained in the off-gases, i.e., a flyash removal system. By "substantial portion" in this context is meant that the particulate removal arrangement is generally constructed for operation within whatever parameters are appropriate for the concern of the operator, typically environmental controls. The precise percentage removed will depend not only on the environmental concerns, but also on the capabilities of the conventional system applied and the nature of the coal combusted. A typical system is capable of removing about 95% or more (by weight) of the particulate material. Such systems may include, for example, scrubber systems (sometimes referred to herein as aqueous scrubber systems), electrostatic precipitators, baghouses, and labyrinthine particle removal systems.

After passage through the particulate, i.e., particle, removal system, the combustion off-gases are generally exhausted through a stack or the like. The off-gases still include therein entrained particulate material, typically that material not effectively or efficiently removed by the particulate removal system. The particulate materials most likely to be entrained in such off-gases are the smallest particles, since those are generally the most difficult to remove by conventional particulate removal systems. While the size range may vary considerably, typically the particulate material entrained in the off-gases are particles of less than about 10 microns in size, and often less than about 5 microns, and more often less than about 1 micron.

In typical conventional coal-fired combustion processes, stack emissions are evaluated (or monitored) in terms of the opacity of the gases passing therethrough. That is, percent of transmission or percent loss of transmission of light, typically visible light, passing through the gases is measured. The greater the opacity, the higher the contamination of the gases by particulate material. System specifications and government regulations are often phrased in terms of acceptable opacity of the stack gases. If opacity is above some critical level, adjustments in the system to inhibit particle output are required. These may include reduction in combustion rate and power output, or change in coal used.

When it is said that the present invention may be applied to control opacity of off-gases from a pulverized coal combustion process, it means that steps according to the present invention may be applied to either reduce opacity (i.e., provide clearer emissions), inhibit the increase in opacity, or reduce the rate at which opacity increases. That is, the methods of the present invention are "effective" if, when practiced, opacity is lower than it would be in the absence of the application of the invention. In general, the present invention concerns selective removal of a substantial portion of particulates of 1 micron or less in size from a combustion gas stream. Thus, an alternate statement of the present invention is that it may be applied to reduce emissions of ultrafines (particles less than about 1 micron in size or less). In this context, the methods are "effective" if ultrafine emissions are reduced or if they are less than they would be in the absence of the invention.

According to the present invention a method of controlling opacity of off-gases from a pulverized coal combustion process includes a step of injecting an effective amount of substantially noncombustible, preformed, coarse particulate material into the off-gases produced from the pulverized coal combustion process. In certain applications involving energy production in a boiler arrangement, the method may include injecting the material into the boiler system, in either the radiant zone or the convective zone. The method may include injecting the particulate material into the transition zone between the radiant and convective sections. By the term "effective amount" in this context, it is meant that sufficient material is injected to control opacity, or reduce ultrafines, according to the above definitions.

Although advantage is realized by the methods and systems of the present invention as measured by the control of opacity or reduction of ultrafines, these are not the only means by which advantage can be measured. For example, the methods and systems of the present invention are advantageous, and represent an improvement over conventional systems, when greater power generation can occur using the same coal types without violating environmental regulations. Also, advantage may be gained by enabling operation of a particulate collection device such as an aqueous scrubber at a reduced power requirement, or a reduced stack opacity, or a combination thereof.

In the context of "substantially noncombustible, preformed, coarse particulate material," the terms "noncombustible" or "substantially noncombustible" are meant to refer to material that is not susceptible to substantial further combustion under the conditions of the combustion process being controlled. Typical materials such as this include mineral oxides, such as silicon oxides. In the same context, the term "preformed" is meant to refer to material provided in the "substantially noncombustible" and "coarse particulate" state prior to injection into the pulverized coal combustion process. That is, the term is meant to exclude material generated in situ, i.e., material generated from the coal during the combustion process and used without extraction from the boiler. Alternatively stated, the materials are injected in a form which they possessed prior to injection. The conditions of the coal-fired combustion process (boiler) are not used to generate the particulate material in situ. However, the term "preformed" in this context does include within its meaning material generated within a coal-fired combustion process, removed therefrom, and then injected back into a coal-fired combustion process. From the latter, it is apparent that the term also includes within its scope materials injected into a coal-fired combustion process through recirculation, i.e., originally formed in the coal-fired combustion process, removed therefrom, and then injected into the same coal-fired combustion process.

In the context of defining the materials preferably injected, the term "coarse" is meant to refer to particles having a size or diameter of greater than about 1 micron and preferably at least about 2 microns. In this context, when it is indicated that a material has at least a particular diameter or size, it is meant that the material preferably includes, by weight, at least about 70% (and preferably at least about 80%) material having a diameter of that much or more.

When it is said that the method includes a step of injecting the substantially noncombustible, preformed, coarse particulate material into the off-gases from the pulverized coal combustion process, it is meant that any of a variety of injection techniques may be used. The material may be injected, for example, dry, wet, or in a slurry. The material may be injected cool relative to the temperature of the off-gases into which it is injected. If used, preferably, the "cool" particulate material is at an ambient temperature upon injection. The particulate material may also be pre-heated, if desired.

It is foreseen that a preferred material for use as the coarse particulate material is glassy flyash cenospheres, formed during coal combustion. Such materials comprise primarily silicon based oxides and variants such as alumino silicates, and generally have rounded outer surfaces. The materials are relatively inert to the conditions of a coal-fired combustion process, especially those conducted in a boiler for the generation of electricity. The inertness results from the rapid cooling of particles as they transit the boiler combustion gas path. This rapid cooling favors the formation of amorphous solids compared to crystalline substances. The amorphous solids generally exhibit reduced chemical reactivity compared to crystalline substances.

When it is said that the particulate material is injected into the combustion off-gases from the pulverized coal combustion process, it is generally meant that the particulate material is injected while the gases are relatively hot, on the order of about 2000° F. (or 1100° C.) or more, preferably within a range of about 1500°-2400° F. (800°-1300° C.). The particulate material can, if desired, injected into either the radiant zone or convective zone of the boiler system. For example, the materials may be injected prior to the combustion off-gases leaving the boiler or burner arrangement and being transferred to a particulate removal system. The particulate material may be injected into the transition zone between the radiant and convective zones.

In certain preferred applications, it will be desirable to provide the coarse particulate material as recirculated flyash collected from the same combustion process. A preferred application would involve: conduction of a coal-fired combustion process (in a boiler arrangement) for generation of off-gases including flyash therein; removal of the particulate material (flyash), for example, with an aqueous scrubber system; washing the particulate material free of alkali materials thereon; and, introducing (or injecting) at least a portion of the cleansed particulate material back into the boiler arrangement. In some instances it would be preferred to inject the coarse particulate material as an aqueous slurry, to cause a step gradient (for example on the order of about 25° F., i.e., 14° C., depending on the concentration of the slurry) in the temperature of gases into which it is injected. Alternatively, it is envisioned that in certain systems water can be injected without any additional particulate material for certain beneficial effects.

Also according to the present invention a method is provided for inhibiting ash fouling in a system such as the convective section of a boiler arrangement. In general, the method comprises a step of injecting an effective amount of a substantially noncombustible, preformed, coarse particulate material into the combustion process, upstream from the zone in which ash fouling is to be inhibited, typically the convective section of a boiler arrangement. By "upstream" in this context, it is meant upstream therefrom with respect to off-gas flow from the combustion process. In a typical boiler arrangement this will mean injection into either the radiant zone or a transition zone between the radiant zone and the convective zone.

The term "substantially noncombustible, preformed, coarse particulate material" in this context, is generally as defined above with respect to controlling opacity of off-gases and/or reduction in substantial portion of ultrafine particulate (about 1 micron or less) from the gas stream. The preferred material for utilization as the coarse particulate material is generally as defined above for use in the process of controlling opacity of off-gases.

In this context the term "effective amount" means an amount sufficient to inhibit ash fouling, or the rate of ash fouling, relative to the rate of ash fouling in the absence of the step of injection. Thus, it is intended to include within its scope conduction of the method in such a way as to slow the rate of, or the amount of, ash fouling. If ash deposition does occur, the method of the present invention would result in removal of the deposits more readily because of a reduction in the amount of the components that "glue" the flyash particles together. Thus, advantage may be realized by reducing the impact the convective pass fouling, i.e., ash fouling, has on the operation of a coal-fired boiler. This can be measured by an improvement in the boiler capacity and efficiency, reduced maintenance costs, and/or an increase in the types of coal that can be used economically.

Also according to the present invention there is provided a method of conducting a coal combustion process comprising the steps of: combusting pulverized coal to form flyash including a fume component (formed from organically associated inorganics in the pulverized coal) and combustion off-gases; and, injecting a substantially noncombustible, preformed, coarse particulate material into the combustion process. Such a method is an advantageous conduction of a coal combustion process at least because it generally involves improvement with respect to opacity of emissions, power generation, fume content of emissions, or ash fouling. The term "substantially noncombustible, preformed, coarse particulate material" in this context, is meant to be subject to the definitions provided above.

There is also provided, according to the present invention, an advantageous system for production of energy comprising: a boiler arrangement including means for combusting pulverized coal to form off-gases having flyash entrained therein; and, means for injecting a substantially noncombustible, preformed, coarse particulate material into the boiler arrangement. Preferably, when ash fouling is to be inhibited, the arrangement includes means for injecting the particulate material as an aqueous slurry. Also, preferably the system includes means for providing the coarse particulate material as flyash recirculated from generation in the same boiler. Preferably the latter is provided by means of an aqueous scrubber system for removal of the flyash from the off-gases.

In general, the conditions of very high turbulence, relatively high temperatures (on the order of about 1500° F. to 2400° F., i.e., 800°–1300° C. or higher) and variations in coal content render specific definition of the processes occurring within the combustion zones or heat transfer zones of various coal-fired combustion processes difficult to precisely define. Hereinbelow detailed presentations are made which provide some basis for understanding reasons why application to the techniques of the present invention lead to advantage. However, the explanations provided are theoretical, and not intended to be limiting. When processes according to the present invention are practiced, advantages such as those explained result. The theoretical justifications provided appear to be the most likely explanations, and provide a greater understanding of the phenomenon involved.

DETAILED DESCRIPTION OF THE INVENTION

Systems and methods are presented which can be applied to mitigate two types of problems often encountered during the combustion of coal in conventional pulverized coal-fired boilers. These systems and methods include the injection of particulate material, preferably flyash, into a coal-fired boiler to: (1) reduce the quantity of flyash particulate, especially fume particulates in exiting stack gases; and/or (2) reduce the tendency for certain coals to form concrete-like deposits (ash fouling) in the convective pass section, i.e., convective zone, of the boiler. Both of these effects can be used to advantage in reducing the environmental impact of particulate material, and in reducing potentially catastrophic maintenance costs resulting from ash fouling.

In general, the processes and systems described herein concern pulverized coal processes, i.e., processes in which the feed coal for combustion has been pulverized, wherein typically about 70–80% of the material has a particle size of less than about 200 mesh. While the methods and arrangements described herein may be applicable to other situations, they are uniquely adapted to improve pulverized coal combustion processes.

Each coal has a unique composition and distribution of components within its hydrocarbon matrix. Thus, when combusted, each coal forms a unique flyash. Some coals, such as those found in parts of the Powder River Basin in the United States, have generally low mineral content. This effectively causes the organically associated inorganic materials in the coal to form a very fine flyash or fume, in a proportionately larger part of the total flyash content, than coals having a large content of mineral inclusions. This flyash composition, (i.e., high in flyash from organically associated inorganics relative to flyash from mineral inclusions) can create problems with state-of-the-art particulate removal equipment. Both wet-scrubbers and baghouses are designed for a particular range of particle size removal efficiencies. In both cases, as particles become smaller in size, they become more difficult and more costly to remove. Thus, fume is particularly difficult for such systems to remove.

In some cases, where a substantial part of the organically associated inorganics is composed of alkali metals, such as sodium and/or potassium, an alkali rich vapor, i.e., vapor fume, is created by the combustion process. The OAI's are released as very fine (ultrafine) particulate material, on the order of about 1 micron or less, or vapor. The vapor fume typically condenses in the convective zone of the boiler as the combustion gas temperatures cool to below about 1500° F. (800° C.). Alkali vapor condensation is instrumental in forming ash deposits on heat exchange surfaces at temperatures in the convective sections of boilers, where temperatures of several hundred degrees above and below 1500° F. (800° C.) are common.

Samples of ash deposits taken from the convective sections of coal-fired boilers indicate that alkali-rich deposits form part of the "glue" that bonds "captured" mineral particles together. Together, these and other constituents, such as sulfur, build a heterogeneous cement-like material that can be difficult to remove from heat exchanger tube surfaces. There are a number of variables which contribute to the strength and tenacity of an ash deposit. They include the degree of sulfation, deposit hysteresis, mineral morphology, dispersion of acid/base constituents, temperature, residence time and reactivity. According to the present invention a method is provided to reduce the concentration of alkali-rich deposits (glue) on the flyash, thus inhibiting flyash fouling. This is done by diluting the combustion gases with coarse particulate material. This material provides greater surface area for collection of fume condensate, thereby resulting in overall lower "glue" concentration. Where an initial flyash deposition does occur, removal of it is enhanced by the reduced binding strength that a lower "glue" concentrate will have.

Stack emissions are similarly controlled. In particular, by forcing a vapor-phase condensation (or fume collection) on cooler surfaces, a net reduction in the concentration of fume occurs. This results in a reduction in the value of stack opacity and/or the presence of ultrafines. Specifically, the fume content can be reduced by adding an appropriate particulate material, preferably flyash, to act as a condensation/impaction surface for coals that produce relatively high amounts of fume and unacceptable stack opacity values.

PARTICULATE EMISSIONS REDUCTION

As previously indicated, the principle methods of controlling particulate emissions from combustion processes concern particulate removal methods applied downstream from the combustion and heat exchange (boiler) system. Conventional methods, involving scrubber systems, baghouses, particulate deposition systems and electrostatic precipitation systems, generally are most efficient with respect to the removal of larger particles. Thus, for example, there are many systems which are relatively efficient at the removal of particles of about 2–100 microns in size, but not smaller particles. As a result, they are notoriously inefficient for the removal of particulate material in the fume, i.e., particulate material typically generated from the organically associated inorganics in the coal.

A basic concept to the present invention is the enhancement of association between the particles in the fume and larger particles in the flyash, for example the glassy mineral oxide cenospheres. The greater the amount of association which occurs, of this type, the greater will be the likelihood that the particulates carried in the combustion fume will be removed through its association with larger particles, in the downstream particle removal processes.

Particle/particle interactions under the high temperatures and turbulent conditions of a combustion processes are relatively complex and not fully understood or evaluated. Those two processes also appear to be most significant with respect to applications of the present invention. These are vapor-phase condensation and Ostwald Ripening.

Under the very hot turbulent conditions of a combustion process, certain particles are generated which are sufficiently hot to exhibit a viscous surface character. In particular, particulate material in the fume may exhibit such a nature. Under the conditions of a combustion process, such particles are in turbulent, violent, motion. They tend to collide and stick together to form larger particles. The formation of these larger particles is generally referred to herein as "Ostwald Ripening." In some applications of the present invention, Ostwald Ripening may be enhanced to encourage the generation of larger particles from smaller ones. The net effect of this, again, is to effectively reduce stack emissions since the larger particles can be more readily removed by the downstream particulate removal systems such as scrubbers, baghouses, and the like.

Fume materials formed from organically associated inorganics in the coal, for example vapor-phase sodium oxides, potassium oxides and similar materials, will tend to condensate on surfaces within the system, as they begin to cool. If the conditions of the environment within the combustion system, for example, boiler, can be manipulated such that substantial vapor-phase condensation of the fume will occur, then the vapor-phase condensation may be utilized to enhance removal of such materials from the off gases. In particular, the larger glassy mineral oxide flyash component presents a relatively large surface area available for condensation of the fume. If the conditions can be manipulated to enhance condensation on the glassy mineral oxide particulates, then the fume will in effect be "scrubbed" or removed from the system, when the larger particles are removed.

The general method of the present invention involves injecting substantially noncombustible, preformed, coarse particulate material, preferably flyash mineral oxide cenospheres (mineral associated flyash particulates which are formed from the mineral oxides and which are normally carried out of the boiler by the combustion gases), into the boiler at a preferential location. The injected or added particulate material can act as a condensation surface for the fume and in effect vastly increase the condensation surface area for the fume particulates. The source of the added coarse particulate material can be the flyash which has been collected by the boiler's ash collection system. That is, the added flyash may be material removed downstream from the combustion system (boiler) and recirculated. In this manner, the total flyash loading on the system and the ash collection system (ash pond life) are not increased.

Glassy flyash cenospheres are the preferred material for several reasons. Such material is readily available and inexpensive. It also has desirable material (physical) properties. For example, the cenospheric shape of such materials provide for a good condensation surface. Furthermore, such materials are relatively chemically inert under the conditions of the boiler due to their generally "glassy", i.e., amorphous, as opposed to crystalline, characteristics. In fact, since flyash cenospheres are initially formed in a boiler process, they are typically inert to any further exposure thereto.

The method of injection of the particulate material can be any typically used in normal material feed systems. For many applications, it preferably involves pneumatic injection. Hydraulic injection can also be used, for example, if a water borne slurry system is desired.

ASH FOULING REDUCTION

As stated above, the generation of flyash during combustion is a complex process, but current knowledge indicates that some of the flyash from the OAI's forms in small beads (typically 1 micron or less) on the surface of a burning char particle. Other flyash from the OAI's, notably the alkali compounds such as sodium and potassium oxides, are actually vaporized in the combustion process and exist as a vapor-phase in the highest temperature part of the boiler (the radiant section). These vapor-phase alkali materials eventually condense out in the cooler part of the boiler (the convective section), and can contribute to the fine flyash problems, as well as create a problem known as ash fouling.

Ash fouling occurs when flyash particles begin to accrete in the convective section of the boiler. The deposits can grow, harden and cause severe limitation to generating station operation. The propensity of a coal to exhibit fouling tendencies is often related to the coal's active alkali concentration. Alkalis are usually considered to be "active" when they are either in the form of organically associated inorganics, or associated with very fine mineral inclusions in the coal. In essence, the alkali component is more readily available for vaporization from these sources than if it were present in a large silica-based mineral inclusion. Fouling occurs when the alkali condenses in sufficient concentration on surfaces to form a "glue," allowing larger flyash particles to stick together and deposits to build.

Virtually all coals have some alkali present during coal combustion, but not all coals exhibit a tendency to foul, and different boilers will exhibit different tendencies to foul when using the same coals. The initial deposition of a fouling deposit may be associated with some critical alkali concentration, and temperatures that are high enough to render other complex mineral phases plastic. The tendency for fouling deposits to harden is often associated with the deposits becoming sulfated, due to the presence of sulfur in the gas stream.

If the volatile alkali proportion can be reduced below a critical level, there is insufficient "glue" to make a problematic bonded deposit. The methods and systems of the present invention make use of this and several other factors to simultaneously create an environment which discourages bonded flyash formation, i.e., ash fouling. The methods and systems for ash fouling reduction are similar to that described above with respect to the reduction of particulate emissions. That is, coarse particulate material (preferably flyash cenospheres) are injected into the system to remove the fume, i.e., glue, before it can create ash fouling problems. This is done primarily through a dilution effect, i.e., the ratio of cenosphere surface area to fume is increased until the ash fouling propensity is effectively improved.

In certain preferred applications a hydraulic injection system is used, whereby particulate material, preferably flyash, is carried in an aqueous slurry and injected into the boiler at a preferred point (presently thought to be the transition zone between silica and sulfated ash deposition regions). In this case, classic Ostwald Ripening is not believed to be involved. Rather, it is believed that the system depends upon a nonthermal equilibrium condition existing between the injected flyash and the combustion environment around it.

A typical method for controlling ash fouling is to limit the exit gas temperature of the radiant section below a critical value. This often limits the power capacity of a boiler, however. Providing an aqueous slurry for injection into the boiler can be used to produce a gradient step change in combustion gas temperature. This will provide a means by which the temperature of the radiant section is maintained while effectively controlling the radiant zone exit gas temperature below the critical value. As a result, this will also reduce the tendency for minerals near the critical viscosity to stick together. In addition, using particulate material, preferably flyash cenospheres, provides for a high surface area, glassy (reduced reactivity) material that can act as a condensation surface for vapor phase alkali materials. Furthermore, using particulate material, preferably flyash cenospheres, in a slurry allows for the prior removal of alkali materials, and for the concentration of larger particles (by centrifuging and reslurrying).

Thus, a solution to the problems of fine particulate generation and fouling of certain coals and boilers is found with injecting a particulate material of certain characteristics. The particulate material will act as a condensation site for vapor-phase alkalis, and result in a net coarsening of the flyash. Experimentation has shown that an injection rate of approximately 280–310 lbs flyash/minute above the highest burner elevation and generally below the boiler arch in a 500 MW boiler can effectively reduce the fine flyash particulate of a Dietz seam coal. Other rates may be useable, however.

ENGINEERING OF A TYPICAL FLYASH INJECTION SYSTEM

A typical pulverized coal electric generating station has 500 MW of generating capacity. Such a station usually has an overall efficiency of about 33% when operating at peak capacity. In power generation terms, the station efficiency is usually expressed as a heat rate. For example, a station operating at 33% efficiency translates into a heat rate of about 10,500 Btu/kWhr.

Different coals will produce different flyash characteristics in the typical boiler. A subbituminous coal such as a Rosebud seam coal with a heating value of 8,600 Btu/lb and a 10% flyash content will generate 1,033 lbs flyash/minute in the typical boiler. A subbituminous coal such as a Dietz seam coal with a heating value of 9,400 Btu/lb and a 4% flyash content will generate 368 lbs flyash/minute in the same boiler, when operated at 500 MW.

The Rosebud coal is relatively high in silica-based minerals, and produces a flyash which is fairly coarse in distribution, and is relatively readily removed from the gas stream by conventional wet scrubbing technology.

The Dietz coal, possibly because of its low total flyash content, is proportionately high in organically associated inorganics. As a result of this composition, when Dietz coal is burned in a pulverized coal boiler, it generates a flyash from the OAI's having a relatively high percentage of fine particulate material (fume), which can be difficult to remove with conventional scrubber type technology.

Shown graphically in FIG. 1, what is sought by the present invention is to shift the distribution of particulate material composition by size. That is, a characteristic of certain preferred embodiments of the present invention is that flyash can be recirculated in a boiler system to advantage by manufacturing a shift in particle size distribution to larger particles. The unbroken line in FIG. 1 indicates a typical bi-modal distribution of flyash particles by size. The broken line indicates a shifted bi-modal distribution of flyash that exits the boiler following application of the present invention. The flyash represented by the peak that occurs at less 1 micron in size is generally evolved from the organically associated inorganic fraction of the pulverized coal. The flyash represented by the peak at about 10 microns in size is generally evolved from the mineral inclusion fraction of the pulverized coal. The broken line indicates a relative reduction in the amount of very fine particle-size flyash representing a net "coarsening" of the particle size distribution of the flyash.

Preferably, the injected particulate material is relatively coarse, inert, and economical. About 70–80% of the particle size of the material is at least about 2 microns. Particulates smaller than about 2 microns are not generally desirable and can be filtered out of a source of such materials. A chemically nonreactive substance is preferred. Also, a substance is preferred which is nonvolatile while exposed to temperatures of 2500° F. (1375° C.) for periods of up to two seconds. The substance should also be readily available and inexpensive.

A nearly ideal particulate material, with little need for modification, is flyash cenospheres of appropriate size classification. What modification may sometimes be desired can be easily accomplished. Preferably, the material used is recirculated from the combustion process being controlled, providing the added benefit of no net increase in flyash disposal problems.

In the case of fouling, particulate injection could be manipulated to allow several processes to mitigate the tendency of convective section fouling. First, injecting a particulate material can simply dilute the effective concentration on any glassy surface of the vapor-phase alkali condensate. A Dietz seam coal with 8.5% sodium oxide concentration, operated in the typical 500 MW boiler can have its sodium oxide concentration effectively reduced to 4.25% by injecting 368 lbs/min of coarse particulate (i.e., by diluting the flyash particulate by about half). Based on a simple concentration rating this changes the fouling potential of the Dietz seam coal from "severe" to "moderate."

Second, since the coarse particulate material is preferably injected cold, i.e., at ambient temperature into the boiler, it can act as a disproportionately efficient condensation surface for vapor-phase alkali materials. Additionally, the residence time of the particulate material within the system can be adjusted to be short in relation to the time it takes, due to the relative coarseness of the particles, for it to heat to a critical viscosity, where it will begin to exhibit sticking behavior.

Third, if the particulate material is injected wet into the boiler, as in a slurry, the vaporization of water can be used to produce a step reduction in furnace exit gas temperature, which can reduce the tendency for flyash, which has traversed the combustion zone, to stick.

Nonthermal equilibrium conditions allow the flyash to: act as a disproportionately efficient condensation surface for vapor-phase inorganics; and maintain viscosity of condensed species above a critical level until it has been carried through the zone of temperatures sufficiently high to cause deposition.

Particulate material injected into a boiler, when it is at ambient temperatures (approximately 70° F., i.e., 20° C.) is substantially cooler than the boiler environment, which may be at temperatures approaching 2400° F. (1300° C.). This strong thermal gradient causes the particulate material to heat rapidly. However, the fact that the particulate material enters the system dramatically below the boiler's environmental temperature also makes the surface of a particle disproportionately efficient as a condensation surface (on a per unit area basis) compared to the other heat transfer surfaces available to flyash constituents released from the combustion of coal. As a result, the deposition rate of vapor phase alkalis will be initially very high. In addition, impaction and retention of fume particles due to thermophoresis may also be high during the short interval when the injected particulate material is undergoing rapid heating.

If the system were allowed to come to thermal equilibrium at the point of injection, a significant amount of the deposited material may either revaporize, or be removed by other processes. The injected particulate material is, from the moment of its injection, in rapid movement towards, and through, the convective pass of the boiler. Thermal equilibrium with the system is rapidly attained, but at a location which is significantly lower in temperature than the point of initial injection, and high rate of deposition onto the injected particulate material. As a result, revaporization or removal of solid phase adherents to the particle will be minimized. This effectively removes a substantial amount of the fume-category particles from the system, and results in a net coarsening of the flyash distribution in travel through the boiler.

In addition, the momentary coolness of the injected particulate material can momentarily keep the viscosity of deposited vapor phase alkalis above the critical sticking viscosity. If the point of injection is correct, this moment of nonsticking behavior can traverse the normal zone within the boiler where fouling may be expected. Again, by the time the injected particulate material and surface deposited flyash constituents reach thermal equilibrium, the environment surrounding the particle is substantially cooler.

The total mass flow of injected particulate material (and water, if a slurry injection system is used), is small in relation to the overall flows and heat transfers within the boiler. As a result, the total inefficiency created by introducing such a large specific thermal gradient in the boiler is small. The net result is that the nonthermal equilibrium nature of the system allows a disproportionately large amount of "problem" flyash species, vapor phase alkalis and, perhaps fume, to be accreted to larger, largely inert particles, where they may be removed by conventional technology.

A generalized sketch of a typical 500 MW boiler 10, according to the present invention, is shown in FIG. 2.

Pulverized coal is injected along lines 11 and 12 through burners 14 into a radiant zone 16 of the boiler 10. The combustion gas and flyash travel upward along the direction of line 20, out of the radiant zone 16, through a transition zone 22, and through a convective zone 24. Although a variety of injection sites may be used, in FIG. 2 the particulate material is preferably injected along line 28 into the transition zone 22 above the top of the burners 14, and generally below a "nose" or arch 30, of the boiler 10. This does not mean that the injection must be restricted to being below the arch 30 for example, the transition zone 22 can extend somewhat above the level of arch 30.

A modification of this system may be required if the particulate material used is recirculated flyash. See FIG. 3. If the flyash is collected dry in a recirculation system, it may be found desirable to classify the flyash (before recirculation into the boiler) by stripping off its very fine fraction (preferably less than about 4 microns).

As shown in FIG. 3, the overall process, which includes flyash recirculation, uses a system consisting of boiler 10, a particulate collection device 40, and a classifying device 42. Flyash exiting the boiler 10 at an exit port 44 enters the particulate collection device 40 along the direction of line 48. Flyash is collected in the particulate collection device 40 with an efficiency characteristic of the specific type of device used. Cleaned combustion gases, i.e., combustion gases with at least about 95% by weight of the entrained particulate material removed, is transported along the direction of line 52 to a stack 54 for release into the environment. A portion of the collected flyash is conveyed from the particulate collection device 40 along the direction of line 58 for disposal or use elsewhere. The remaining portion of the collected flyash is conveyed along the direction of line 60 into the classifying device 42. A coarse fraction, containing particles having a diameter of at least about 2 microns, is conveyed along the direction of line 66 for injection into the boiler 10 within the transition zone 22. A fine fraction containing particles having a diameter of less than the selected size (for example less than about 2 microns) is transported along the direction of line 68 for disposal or use elsewhere.

The particulate collection device 40 can be any of a variety of conventional devices for purifying the combustion gas stream. For example, if the particulate collection device 40 is a dry collection device, baghouses or electrostatic precipitators can be used. Also, if the particulate collection device 40 is a dry collection device, the classifying device 42 can be a cyclone separator or a secondary particulate collection device such as a coarse-weave baghouse, electrostatic precipitator, or a settling chamber. Preferably, the classifying device 40 is a cyclone separator.

Figure 4:
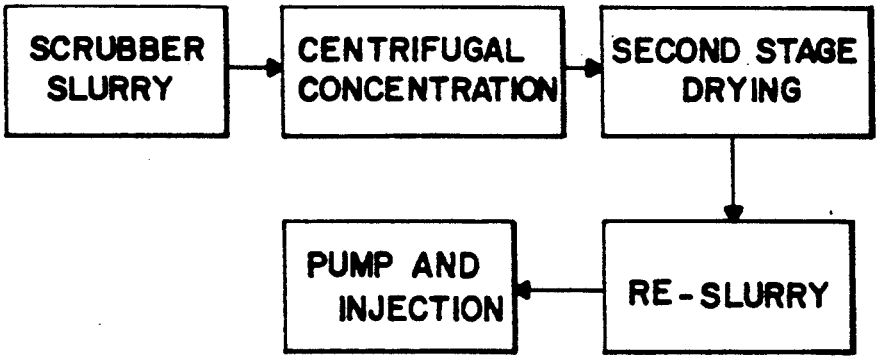
FIG. 4 is a flow chart of a reslurry technique used in a preferred embodiment of the present invention when the source of particulate material is from a flyash wet scrubber.

In the overall system of the present invention that includes a recirculation arrangement, if the flyash is extracted wet, as for example if particulate collection device 40 in FIG. 3 is a wet scrubber, the flyash can be centrifugally concentrated rather than classified in the classifying device 42 in FIG. 3. The concentrated flyash can then be either dried and pneumatically injected, or reslurried and injected as a water borne spray. The particular system for carrying out the centrifugal concentration, drying, and reslurrying would replace the classifying device 42 following the collection device 40 in FIG. 3. A flow chart of the reslurry system is shown in FIG. 4.

The reslurry system and method preferably involves subjecting the raw scrubber flyash slurry, which contains about 11% solids and is collected in a particulate collection device, to a centrifugal concentration process, and then to a second stage drying process wherein further concentration of the wet scrubber flyash slurry occurs. The concentrated flyash is then combined with water from a secondary source in a reslurry stage of the process. This secondary source of water has a substantially lower concentration of dissolved solids and alkali materials contained therein than the water removed from the concentration and drying stages. The reslurried flyash is then pumped to the boiler and reinjected as shown in FIGS. 3 and 4 into the transition zone 22. The centrifugal concentration process can be carried out in a concentrator, clarifier, or other similar known device. The second stage drying process can use either a vacuum filter belt or other technique.

If the flyash is extracted from a wet scrubber, a significant amount of the accumulated weak-acid leachable alkali material will have been removed from the coarse flyash, due to the fact that many wet scrubbers operate at a somewhat acidic pH (3.7 to 3.8). This can benefit the overall system because the alkali material is not reinjected into the boiler.

In the example of a typical 500 MW generating station operating on Dietz seam coal, a 50% recycle ratio would require a flyash mass flow recycle rate of 368 lbs/min. If a 30% solids content were used in the final, or reslurry, a water flow rate of 859 lbs $H_2O$/min, or 103 gallons per minute, would result. Based on a typical 20% excess air in firing of the typical 500 MW boiler, there is sufficient heat capacity in 103 gpm to provide a step reduction of approximately 25° F. (14° C.) in the furnace exit gas temperature. This amount of reduction is approximately the desired amount of control in a furnace exit gas temperature control scheme, where a 25°-50° F. (14°-28° C.) reduction in temperature can mean the difference between clean operation and fouling problems.

Figure 5:
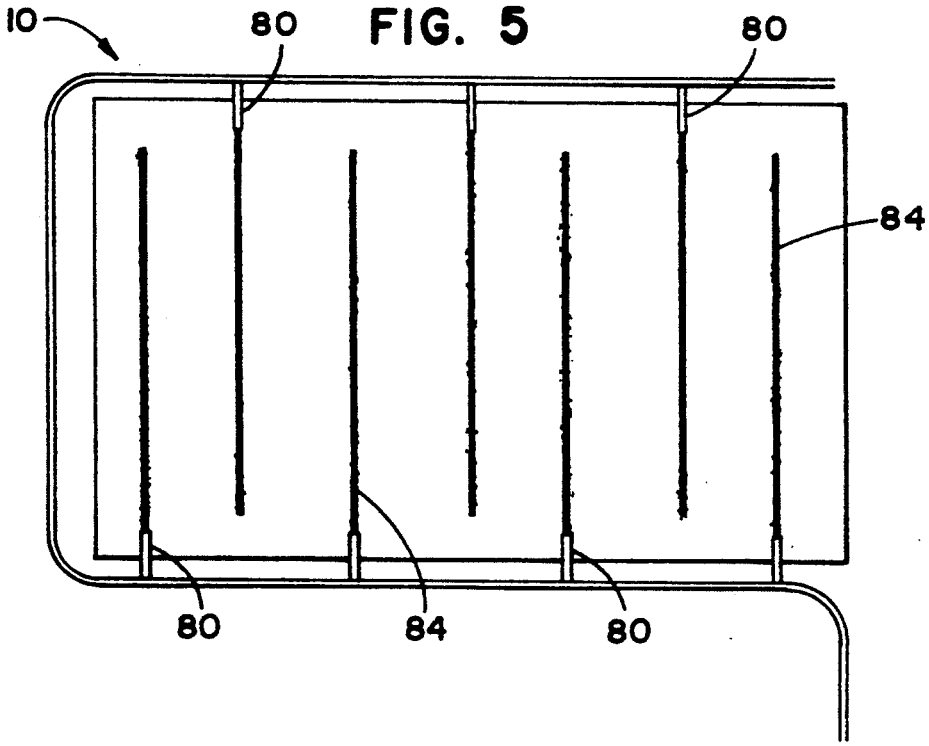
FIG. 5 is a schematic diagram of a cross-section of the boiler used in a slurry injection system.

If the flyash is reinjected as a slurry, it may be found desirable to introduce the slurry in such a way as to make as homogeneous a distribution within the boiler as reasonably possible. As shown in the cross-section of boiler 10 in FIG. 5, the flyash slurry can be injected through a multiplicity of nozzles 80. The cross-section in FIG. 5 represents that taken along line 5—5 in the boiler 10 of FIG. 3. The number of nozzles 80 depends upon the amount of slurry being injected and the flow characteristics of the slurry mixture. The slurry nozzles 80 are designed such that each one shoots a horizontal stream of slurry 84 across the boiler and at a pressure such that the water in the slurry vaporizes before hitting the far wall. A double header arrangement with nozzles on both sides of the boiler would help assure a very even distribution of slurry occurs in the boiler. This is desireable because a good homogeneous mixing of the combustion gases with the flyash slurry occurs in the plane of injection of the slurry and perpendicular to the upward flow of combustion gases.

In the design of a particulate injection system for fouling control, a wet injection system may have advantages over a dry system. The use of a spray header arrangement as shown in FIG. 5 will introduce a small step decrease in the furnace exit gas temperature. Preferably, this step decrease in temperature of the combustion gases is at least about 25° F. (14° C.) and occurs in the transition zone. The rate of injection of slurry, and its solids content, can be controlled for greatest effect. One of the problems encountered with a coal that has a tendency to foul is that furnace exit gas temperature must be closely monitored and limited. This often places a restriction on the achievable capacity a generating station can produce. Use of a slurry injection system can not only help control fouling through dilution and condensation of vapor-phase alkalis, it can help control furnace exit gas temperature. This can allow the radiant section to be fired at a higher rate, a sometimes desirable condition.

The present invention will be further described by reference to the following detailed examples.

EXPERIMENTAL INJECTION OF FLYASH

The theory that flyash injection can be used to control stack opacity resulting from a very fine particulate fume in a pulverized coal ("PC") power plant was tested. A Dietz seam coal, which is very low in sulfur and total flyash content, was evaluated. This was done in a generating unit consisting of a pulverized coal boiler (520 $MW_{net}$ production and a venturi scrubber, herein referred to as "Unit #4"). Burning this coal typically produces an opacity problem. Based on the known flyash composition for this coal, it was believed that the opacity problem was due to a very fine particulate emission, which the existing wet scrubber was unable to effectively remove.

Equipment was set up to allow pneumatic injection of flyash into the power generating unit. A large (25 ton capacity) solids-carrying truck capable of pneumatic delivery of its three on-board hoppers was used in the experiment. The truck's rated delivery rate under normal operating conditions was 1,000 pounds per minute. In addition to the truck's own blower system, a diesel engine driven blower, was used. A temporary pneumatic line, 6 inches in diameter, was run from the ground level to the boiler above the top burner elevation, and below the boiler's arch. At this elevation, the pneumatic line was bifurcated into two 6-inch diameter lines running horizontally and parallel to one of the boiler walls. At approximately this same elevation on this same wall of the boiler, near the corners, are inspection ports for viewing into the boiler. These ports are approximately 9 inches wide and 12 inches tall. The two 6-inch lines terminated in these inspection ports. High temperature insulation was placed around the 6 inch lines to seal the ports.

The truck was filled with dry flyash, which was extracted dry from the combustion gases using baghouses. The flyash used in the injection process was produced from burning coal from the Rosebud seam from the Powder River Basin in Montana (Peabody coal). The flyash is relatively high in silica and mineral content. The flyash was believed to be relatively inert chemically, with a relatively high percentage (>95% by weight) of coarse particles, i.e., in the range of about 2–200 microns.

After filling the truck with flyash, it was connected to a temporary pneumatic injection line. Introduction of the flyash into Unit #4 could then be accomplished by turning on one or both of the blower systems, and opening the valves at the bottom of each of the truck's hoppers. The valves discharged into the truck's pneumatic transport line, which was connected to the temporary 6 inch line. Control of the rate of injection was rudimentary. By opening a valve half-way, it was determined that approximately 280–310 lbs per minute of flyash were being injected.

UNIT #4'S OPERATIONAL DESCRIPTION

Unit #4 is a corner-fired PC unit capable of a nominal 520 $MW_{net}$ production. During the course of the experiment, it was operated at a nominal 510 $MW_{net}$, or, nearly at full capacity. Unit #4 has been found to have an opacity problem when operating on Dietz seam coal. It is believed that this opacity problem is a result of a relatively large proportion of very fine (about 1 micron) particulate material generated in the combustion process by the relatively high content of organically associated inorganics in this coal. Prior to this, normal opacity control procedure involved burning a portion of Rosebud seam coal combined with the Dietz seam coal, both to reduce the proportion of Dietz seam coal contributing to the boiler's throughput, and also to provide a source to which fume-type particulate can accrete. Unit #4 can be operated at full load on 5 fully loaded pulverizers (when using Dietz seam coal), which control the rate of fuel injection into the boiler. Unit #4 has seven pulverizers, which facilitates switching in and out of various coal burning schemes. During Dietz coal operation, one pulverizer was operated with Rosebud seam coal.

In order to test the flyash injection theory, it was necessary to obtain full operation on Dietz seam coal. During this particular experiment, two pulverizers were in the process of switching over from Rosebud seam coal to Dietz seam coal; a process of about several hours duration. Coal was fed into the pulverizer from large conical bunkers which reside above the pulverizers. For operational and safety reasons, the bunkers were not run until empty. As a result of this and because of the conical design, when a new coal was dumped into a partially full bunker, some mixing between the two coals occurred for a period of time, usually one or two hours. Observation of the $SO_2$ emissions was used as a monitoring means to determine when the unit was completely switched from a mixture of Rosebud seam coal and Dietz seam coal to a total Dietz seam coal operation. Due to the lower sulfur content of the Dietz coal (0.10 lbs $SO_2$/MMBtu) compared to the Rosebud coal (0.32 lbs $SO_2$/MMBtu), as Unit #4 was switched from Rosebud to Dietz operation, the $SO_2$ monitor characteristically dropped from the higher level of the Rosebud coal to the lower level of the Dietz coal.

Unit #4 has a wet venturi scrubber for particulate removal. It is a controllable device in that its ability to remove particulate material can be increased by increasing the pressure drop across the venturi (usually referred to as scrubber differential pressure). This can be accomplished by mechanically lengthening the venturi, which the Unit #4 scrubber is equipped to do. The scrubber differential pressure is controlled in concert with the opacity monitor. Unit #4 is required to operate at an opacity not exceeding 20% over a 6 minute running average. The opacity is measured both as the six minute average opacity (average opacity), and instantaneously (instantaneous opacity). When the instantaneous opacity exceeds 20%, the scrubber differential pressure is increased, to maintain the opacity below 20%. The scrubber actually consists of several venturis operating in parallel. During normal operation three venturi trains, or modules are in service.

Under normal operating conditions, the scrubber could be maintained at lower than 20% opacity. There is, however, a variable cost associated with operating the scrubber. Increasing the scrubber differential requires more fan horsepower to draw the same amount of combustion gas throughout the venturi. The increase can be quite significant with a commensurate increase in the operating cost of the system. As a result, proper scrubber operation usually controls the average opacity to around 19.8%, and scrubber differentials of about 15 inches water column are considered nominal.

EXPERIMENTAL RESULTS

Four series of tests were performed. The first test initiated injection of flyash at 7:00 a.m. and was completed at 9:30 a.m. on Jun. 11, 1991, with no apparent affect on Unit #4. Initially it was believed, by evidence of the $SO_2$ monitor, that the switchover from the Rosebud seam coal to Dietz seam coal was not complete. During the test, the $SO_2$ monitor record indicated that the $SO_2$ concentration remained above 0.30 lbs $SO_2$/MMBtu for the entire period.

The second test initiated flyash injection at 10:30 a.m., and concluded with the truck running out of flyash at 12:30 p.m. on Jun. 11, 1991. During the interval of the second test, Unit #4 was switched over to operation on Dietz seam coal, as evidenced by the $SO_2$ monitor. At the start of the test, the $SO_2$ monitor indicated an $SO_2$ level of 0.28 lb $SO_2$/MMBtu. The $SO_2$ concentration fell steadily throughout the test, and was at 0.09 lbs $SO_2$/MMBtu at the test's conclusion at 12:30 p.m.

During the interval of flyash injection in the second test, the scrubber was operated at an average differential between 13 and 14 inches water column ("WC"). The 20% average opacity was not exceeded during this interval. Essentially, the scrubber was indicating that the overall system was in satisfactory operation, and operation of 100% Dietz seam coal was being achieved. The truck carrying the flyash temporarily ran out of flyash at approximately 12:20 p.m. The second hopper of the truck ran out of flyash, and the truck's operator took approximately one to two minutes to switch over to the last hopper which was nearly empty. A sharp increase in instantaneous opacity was noticed at this time. The average scrubber differential was increased to slightly over 18 inches water column at this time. Stack opacity was rapidly reduced. This allowed scrubber differential to be reduced momentarily to 12 inches water column.

At 12:29 p.m. the last hopper in the truck ran out of flyash. At this time, the instantaneous opacity made a sharp increase, the average opacity began to increase, and the scrubber differential was increased. At 12:33 p.m. the instantaneous opacity was at 26%, the average opacity was at 22% and rising, and the scrubber differential was at 21 inches water column ("WC"). At this time, one pulverizer with Dietz seam coal was removed from service and replaced with a pulverizer operating on Rosebud seam coal. In response the scrubber differential and opacity were both reduced. This injection of flyash at an approximate rate of 310 lbs/min definitely affected the Unit #4 scrubber/opacity relation on Dietz seam coal.

The third test was initiated at 10:20 a.m. on Jul. 3, 1991. The Unit #4 was switched over to Dietz seam coal, essentially completely for the test. That is, $SO_2$ emissions were about 0.10 lbs $SO_2$/MMBtu at the start of the test. The test repeated the methodology of the first two tests, but with slightly improved instrumentation. The changes in scrubber venturi pressures were recorded every minute as well as the instantaneous opacity. In addition, the flyash truck was weighed before and after the test.

In order to measure the response time of reaction, a stop watch was matched against the instantaneous opacity. Unit #4 was operating at 510 $MW_{net}$, when flyash injection was initiated at 10:20 a.m. The instantaneous opacity was at 18.9%. The opacity remained constant for 45 seconds, then dropped to 18.5%. The opacity was at 18.3% at 60 seconds, and was at 17.9% at 70 seconds. The scrubber average differential pressure was then decreased to account for the decrease in opacity.

At 10:45 a.m., Unit #4 had removed all Rosebud coal from operation and was being operated entirely on Dietz seam coal and injected flyash. Stack opacity was maintained under 20% while maintaining a scrubber differential of between 12 inches WC and 16 inches WC until flyash began to run out at 11:00 a.m. Rosebud coal feed was re-initiated at 11:10 a.m. This third test demonstrated that a simple flyash injection system could effectively maintain opacity within acceptable limits, and at acceptable scrubber differential pressures.

The flyash truck was weighed. The difference in weight indicated that a flyash feed rate of 280–310 lbs/min was used during the test. The data is reported below in Table 1.

The fourth test attempted to place a lower limit on the acceptable feed rate of flyash to Unit #4. Unit #4 was operated at 510 $MW_{net}$.

Flyash feed was initiated at 12:14 p.m. on Jul. 3, 1991. The initial conditions of Unit #4 included opacity at 18.1%, and scrubber differential pressure at 18.07 inches WC. The flyash feed valve was opened, but not as far as during the third test. No sudden reduction in opacity occurred, as had in the test before. However, after 2 minutes scrubber differential pressure had dropped to 17.8 inches $H_2O$, so the decision to remove the Rosebud coal was made. By 12:20 p.m., six minutes into the test, instantaneous opacity was at 26.2%, and scrubber differential was at 19.06 inches WC. The system continued to deteriorate. At 12:21 p.m. the decision was made to re-insert a pulverizer with the Rosebud seam coal, and at 12:22 p.m. the flyash feed rate was also increased slightly. The system responded favorably. By 12:28 p.m. instantaneous opacity was down to 15.7%, and the scrubber differential pressure was down to 16.5 inches $H_2O$. The Rosebud seam coal was again removed at 12:33. By 12:37 p.m., 100% operation on Dietz seam coal and flyash was being maintained. Instantaneous opacity was maintained at 20%±1% with a scrubber differential pressure at 15.5 inches WC until 12:50 p.m., when the Rosebud seam coal was re-inserted, and flyash injection was shut off.

The flyash truck was weighed. The average flyash feed during the fourth test appeared to be between 180–216 lbs/min. The fourth test demonstrated that: 1) without flyash injection, Unit #4 quickly exceeded opacity limits when operated at 100% Dietz seam coal; 2) and a reduced feed rate (180–216 lbs/min) of flyash appeared to be close to the minimum of prudent operation, with the system design used in the test. The data is presented below in Table 2.

The invention has been described with reference to specific and preferred embodiments and techniques. It should be understood, however, that many variations and modifications may be made while remaining within the spirit and scope of the invention.

TABLE 1

Unit #4 Flyash Injection Test - July 3, 1991
Log of Significant Measurements - Test 3

| TIME | A | B | C | D | E | Comments |
|---|---|---|---|---|---|---|
| 1013 | 15.12 | 15.24 | 15.63 | 0.080 | 19.1 | |
| 1014 | 15.10 | 14.98 | 15.72 | 0.080 | 19.6 | |
| 1015 | 15.21 | 15.05 | 15.64 | 0.099 | 19.5 | |
| 1016 | 14.83 | 15.17 | 15.62 | 0.099 | 18.4 | |
| 1017 | 14.84 | 15.17 | 15.69 | 0.097 | 18.7 | |
| 1018 | 15.11 | 15.16 | 15.65 | 0.097 | 17.6 | |
| 1019 | 15.14 | 15.11 | 15.59 | 0.103 | 19.1 | |
| 1020 | 14.91 | 15.22 | 15.59 | 0.103 | 19.0 | Flyash Feed On |
| 1021 | 15.19 | 14.95 | 15.69 | 0.098 | 18.5 | |
| 1022 | 15.13 | 15.33 | 15.55 | 0.098 | 18.6 | |
| 1023 | 15.32 | 15.25 | 15.66 | 0.098 | 18.4 | |
| 1024 | 15.09 | 15.15 | 15.71 | 0.098 | 18.5 | |
| 1025 | 15.25 | 15.10 | 15.57 | 0.095 | 18.1 | |
| 1026 | 15.40 | 15.04 | 15.64 | 0.095 | 18.9 | |
| 1027 | 15.27 | 15.15 | 15.71 | 0.100 | 18.5 | |
| 1028 | 14.86 | 15.15 | 15.62 | 0.100 | 18.6 | |
| 1029 | 14.99 | 15.19 | 15.61 | 0.103 | 17.3 | |
| 1030 | 15.10 | 15.08 | 15.52 | 1.103 | 16.0 | |
| 1031 | 14.51 | 14.34 | 15.01 | 1.103 | 16.6 | |
| 1032 | 13.63 | 13.88 | 14.25 | 0.103 | 17.6 | |
| 1033 | 13.46 | 13.56 | 13.97 | 0.105 | 18.5 | |
| 1034 | 13.57 | 13.78 | 14.18 | 0.105 | 18.0 | |
| 1035 | 13.43 | 13.42 | 13.84 | 0.102 | 20.8 | Began Shutting Rosebud Off |
| 1036 | 13.37 | 13.22 | 13.92 | 0.102 | 18.2 | |
| 1037 | 13.10 | 13.21 | 13.60 | 0.109 | 17.1 | |
| 1038 | 12.66 | 12.71 | 13.25 | 0.109 | 17.4 | |
| 1039 | 12.56 | 12.78 | 13.11 | 0.108 | 18.3 | |
| 1040 | 12.44 | 12.56 | 13.08 | 0.108 | 19.4 | |
| 1041 | 12.49 | 12.44 | 12.92 | 0.099 | 21.4 | |
| 1042 | 13.64 | 13.50 | 14.35 | 0.099 | 22.3 | |
| 1043 | 14.18 | 14.35 | 14.69 | 0.100 | 20.4 | |
| 1044 | 14.94 | 15.03 | 15.63 | 1.100 | 20.2 | |
| 1045 | 15.54 | 15.79 | 16.25 | 0.093 | 18.8 | 100% Dietz Seam Coal & Flyash |
| 1046 | 15.31 | 15.06 | 15.54 | 0.093 | 18.0 | |
| 1047 | 13.72 | 14.13 | 14.30 | 0.095 | 17.0 | |
| 1048 | 13.45 | 13.42 | 13.79 | 0.095 | 20.8 | |
| 1049 | 14.22 | 14.11 | 14.73 | 0.083 | 19.1 | |
| 1051 | 14.21 | 14.42 | 14.65 | 0.083 | 19.3 | |
| 1051 | 14.29 | 14.17 | 14.69 | 0.089 | 17.6 | |
| 1052 | 14.29 | 14.31 | 15.03 | 0.089 | 18.0 | |
| 1053 | 14.21 | 14.25 | 14.68 | 0.092 | 16.8 | |
| 1054 | 13.10 | 13.54 | 13.88 | 0.092 | 17.6 | |
| 1055 | 12.76 | 13.04 | 13.39 | 0.091 | 18.6 | |
| 1056 | 12.59 | 12.76 | 13.27 | 0.091 | 18.9 | |
| 1057 | 12.81 | 12.98 | 13.40 | 0.084 | 19.2 | |
| 1058 | 13.03 | 12.79 | 13.37 | 0.084 | 18.7 | |
| 1059 | 12.92 | 12.81 | 13.30 | 0.083 | 19.0 | |
| 1100 | 12.72 | 12.94 | 13.39 | 1.083 | 19.1 | |
| 1101 | 12.93 | 12.84 | 13.30 | 0.091 | 18.8 | Running Out of Flyash |
| 1102 | 12.85 | 12.96 | 13.27 | 0.091 | 20.3 | |
| 1103 | 12.87 | 12.84 | 13.29 | 0.091 | 21.7 | |
| 1104 | 13.89 | 14.12 | 14.79 | 0.091 | 21.3 | |
| 1105 | 15.26 | 15.37 | 15.80 | 0.089 | 18.7 | |
| 1106 | 15.09 | 15.44 | 15.87 | 0.089 | 20.0 | |
| 1107 | 16.71 | 16.84 | 17.30 | 0.087 | 24.1 | |
| 1108 | 17.88 | 17.73 | 18.28 | 0.087 | 20.7 | |
| 1109 | 18.84 | 18.77 | 19.26 | 0.092 | 19.5 | |
| 1110 | 19.14 | 18.99 | 19.95 | 0.092 | 19.9 | Rosebud Back In |
| 1111 | 19.44 | 19.07 | 19.88 | 0.080 | 16.9 | |
| 1112 | 19.21 | 19.13 | 19.98 | 0.080 | 14.7 | |

Legend

| Column | Units | Description |
|---|---|---|
| A | Inch WC | A Venturi Diff Press |
| B | Inch WC | C Venturi Diff Press |
| C | Inch WC | D Venturi Diff Press |
| D | lb $SO_2$/MMBtu | #4 Stack $SO_2$ Emissions |
| E | Percent | #4 Stack $SO_2$ Opacity |

TABLE 2

Unit #4 Flyash Injection Test - July 3, 1991
Log of Significant Measurements - Test 4

| TIME | A | B | C | D | E | Comments |
|---|---|---|---|---|---|---|
| 1213 | 18.82 | 18.92 | 19.37 | 0.092 | 17.7 | |

TABLE 2-continued

| | | | | | | |
|---|---|---|---|---|---|---|
| 1214 | 17.82 | 17.85 | 18.46 | 0.092 | 20.2 | Flyash Feed On |
| 1215 | 17.82 | 17.96 | 18.54 | 0.095 | 18.0 | |
| 1216 | 17.91 | 17.95 | 18.68 | 0.095 | 20.6 | Rosebud Coming Out |
| 1217 | 18.54 | 18.63 | 19.06 | 0.080 | 22.7 | |
| 1218 | 18.79 | 18.54 | 19.38 | 0.080 | 23.8 | |
| 1219 | 19.07 | 19.01 | 19.79 | 0.085 | 26.9 | |
| 1220 | 19.28 | 18.99 | 19.88 | 0.085 | 27.0 | |
| 1221 | 19.04 | 19.07 | 19.67 | 0.086 | 24.4 | Rosebud Back In |
| 1222 | 19.25 | 18.94 | 19.72 | 0.086 | 19.3 | |
| 1223 | 18.87 | 18.92 | 19.31 | 0.095 | 15.9 | Increase Flyash Feed-rate |
| 1224 | 17.98 | 18.07 | 18.64 | 0.095 | 14.6 | |
| 1225 | 16.21 | 16.36 | 16.94 | 0.093 | 14.7 | |
| 1226 | 16.33 | 16.38 | 17.02 | 0.093 | 15.3 | |
| 1227 | 15.48 | 15.40 | 16.05 | 0.078 | 15.5 | |
| 1228 | 15.31 | 15.40 | 16.00 | 0.078 | 17.4 | |
| 1229 | 14.42 | 14.42 | 15.22 | 0.086 | 19.7 | |
| 1230 | 14.39 | 14.48 | 15.26 | 0.086 | 18.8 | |
| 1231 | 13.92 | 14.04 | 14.56 | 0.090 | 19.0 | |
| 1232 | 14.04 | 13.80 | 14.31 | 0.090 | 18.8 | |
| 1233 | 13.69 | 13.91 | 14.53 | 0.091 | 18.1 | Rosebud Coming Out |
| 1234 | 14.13 | 14.10 | 14.54 | 0.091 | 19.6 | |
| 1235 | 13.71 | 14.08 | 14.68 | 0.099 | 19.8 | |
| 1236 | 14.14 | 14.11 | 14.65 | 0.099 | 19.3 | |
| 1237 | 14.83 | 14.54 | 15.67 | 0.101 | 21.9 | 100% Dietz Seam Coal & Flyash |
| 1238 | 15.51 | 15.61 | 16.11 | 0.101 | 20.3 | |
| 1239 | 16.39 | 16.21 | 16.82 | 0.099 | 19.1 | |
| 1240 | 15.74 | 15.55 | 16.15 | 0.099 | 20.2 | |
| 1241 | 16.04 | 15.91 | 16.50 | 0.086 | 19.8 | |
| 1242 | 16.06 | 16.21 | 16.56 | 0.086 | 18.3 | |
| 1243 | 16.02 | 16.07 | 16.74 | 0.086 | 17.7 | |
| 1244 | 15.27 | 15.13 | 15.69 | 0.086 | 18.9 | |
| 1245 | 15.14 | 15.06 | 15.82 | 0.088 | 18.8 | |
| 1246 | 15.19 | 15.16 | 15.71 | 0.088 | 20.9 | |
| 1247 | 15.56 | 15.65 | 16.23 | 0.079 | 20.5 | |
| 1248 | 16.39 | 16.53 | 17.17 | 0.079 | 22.3 | |
| 1249 | 17.04 | 16.64 | 17.59 | 0.078 | 21.8 | |
| 1250 | 18.03 | 17.80 | 18.36 | 0.078 | 21.6 | Rosebud Going Back/ Flyash Off |
| 1251 | 17.75 | 17.72 | 18.21 | 0.088 | 17.4 | |
| 1252 | 16.76 | 16.83 | 17.33 | 0.088 | 19.3 | |
| 1253 | 16.73 | 16.72 | 17.21 | 0.082 | 19.0 | |
| 1254 | 16.55 | 17.15 | 17.42 | 0.082 | 17.6 | |
| 1255 | 16.94 | 16.75 | 17.32 | 0.087 | 21.4 | |
| 1256 | 17.18 | 17.25 | 17.74 | 0.087 | 19.8 | |
| 1257 | 17.32 | 17.33 | 17.93 | 0.078 | 19.2 | |
| 1258 | 17.40 | 17.30 | 17.78 | 0.078 | 19.4 | |
| 1259 | 17.21 | 17.28 | 17.70 | 0.084 | 19.7 | |
| 1300 | 17.29 | 17.20 | 17.81 | 0.084 | 20.2 | |
| 1301 | 17.30 | 17.39 | 17.76 | 0.091 | 19.4 | |
| 1302 | 17.39 | 17.32 | 17.87 | 0.091 | 19.3 | |
| 1303 | 17.22 | 17.37 | 17.66 | 0.085 | 19.5 | |
| 1304 | 17.29 | 17.29 | 17.86 | 0.085 | 19.5 | |
| 1305 | 17.03 | 17.30 | 17.78 | 0.082 | 18.9 | |
| 1306 | 17.29 | 17.30 | 17.71 | 0.082 | 18.8 | |
| 1307 | 17.12 | 17.38 | 17.97 | 0.087 | 18.2 | |
| 1308 | 17.22 | 17.36 | 17.87 | 0.087 | 18.6 | |
| 1309 | 17.30 | 17.34 | 17.97 | 0.085 | 18.5 | |
| 1310 | 17.30 | 17.50 | 17.76 | 0.085 | 18.7 | |
| 1311 | 17.44 | 17.42 | 17.70 | 0.090 | 18.7 | |
| 1312 | 17.39 | 17.41 | 18.02 | 0.090 | 18.3 | |

Legend

| Column | Units | Description |
|---|---|---|
| A | Inch WC | A Venturi Diff Press |
| B | Inch WC | C Venturi Diff Press |
| C | Inch WC | D Venturi Diff Press |
| D | Lb/MMBtu | #4 Stack $SO_2$ Emissions |
| E | Percent | #4 Stack Opacity |

What is claimed is:

1. A method of reducing an amount of ultrafine particulates in off-gases from a coal combustion process; said method including the steps of:

(a) combusting pulverized coal during a combustion process conducted in a non-fluidized bed boiler to form a combustion off-gas stream including ultrafine particulates which would be at a first level of emission in the absence of a step of ultrafine particulates control as characterized in (b); and, (b) conducting a step of ultrafine particulates control by injecting flyash mineral oxide particulate material into the combustion process in an amount sufficient to provide a level of emission of ultrafine particulates, from the combustion process, which is below the first level.

2. A method according to claim 1 wherein said step of injecting comprises injecting flyash mineral oxide particulates which comprise at least about 70% by weight particles which are at least 2 microns across.

3. A method according to claim 1 wherein said step of injecting is conducted downstream from said step of combusting pulverized coal.

4. A method according to claim 1 wherein:

(a) said step of combusting coal includes formation of a flyash cenosphere component;

(b) said method includes a step of particulate removal wherein at least a portion of the flyash cenosphere component formed in combusting is separated from the combustion off-gases; and, (c) said step of injecting flyash material comprises injecting, at least in part, a portion of the flyash cenosphere component removed from the combustion off-gases.

5. A method of controlling opacity of off-gases from a pulverized coal combustion process; a said method including the steps of:

(a) combusting pulverized coal in a boiler to form a combustion off-gas stream including a fume component formed from organically associated inorganics in the pulverized coal; and, (b) conducting a step of fume component control by injecting an amount of flyash particulate material into the combustion process which is sufficient to absorb at least a portion of the fume component; said step of injecting flyash particulate material comprising injecting flyash material which, immediately prior to injection, is at a temperature no greater than ambient.

6. A method according to claim 5 wherein said step of injecting comprises injecting flyash mineral oxide particulates which comprise at least about 70% by weight particles which are at least 2 microns across.

7. A method according to claim 5 wherein said step of combusting pulverized coal is a non-fluidized bed boiler process.

* * * * *